US009694486B2

(12) United States Patent
Kidd, III

(10) Patent No.: US 9,694,486 B2
(45) Date of Patent: Jul. 4, 2017

(54) TOOL AND TOOL HANDLE

(71) Applicant: Richard Kindley Kidd, III, Portland, TX (US)

(72) Inventor: Richard Kindley Kidd, III, Portland, TX (US)

( * ) Notice: Subject to any disclaimer, the term of this patent is extended or adjusted under 35 U.S.C. 154(b) by 304 days.

(21) Appl. No.: 14/545,395

(22) Filed: May 1, 2015

(65) Prior Publication Data

US 2016/0096262 A1 Apr. 7, 2016

Related U.S. Application Data

(60) Provisional application No. 62/071,868, filed on Oct. 6, 2014.

(51) Int. Cl.
*B25G 1/10* (2006.01)
*B25G 1/00* (2006.01)

(52) U.S. Cl.
CPC ..... *B25G 1/102* (2013.01)

(58) Field of Classification Search
CPC ..... B25G 1/102; B25D 1/00
See application file for complete search history.

(56) References Cited

U.S. PATENT DOCUMENTS

| | | | | |
|---|---|---|---|---|
| 3,585,101 | A | 6/1971 | Stratton | |
| 4,825,552 | A | 5/1989 | Bendickson | |
| 5,097,566 | A | 3/1992 | Decker | |
| 5,234,740 | A | 8/1993 | Reeves | |
| 6,372,323 | B1 | 4/2002 | Kobe | |
| 6,610,382 | B1 | 8/2003 | Kobe | |
| 7,309,519 | B2 | 12/2007 | Scholz | |
| 7,703,179 | B2 | 4/2010 | Ferguson | |
| 8,277,922 | B2 | 10/2012 | Kobe | |
| 2008/0047149 | A1* | 2/2008 | Webb | A47J 17/02 30/278 |
| 2010/0108234 | A1* | 5/2010 | Dennis | B21J 15/105 156/60 |
| 2012/0027990 | A1 | 2/2012 | Kobe | |

FOREIGN PATENT DOCUMENTS

| | | |
|---|---|---|
| JP | 2012158091 | 8/2012 |

* cited by examiner

*Primary Examiner* — David B Thomas
(74) *Attorney, Agent, or Firm* — G. Turner Moller

(57) ABSTRACT

A hand held hammer includes a handle incorporating a series of outwardly extending pegs providing gripping power between the user's hands and the handle. In some embodiments, the pegs are spaced far enough part to make it overly painful to swing the hammer bare handed. In some embodiments, the cumulative surface area of the pegs occupy less than 8% of the surface area of the handle. The pegs may be embedded in a plastic handle, captivated to the exterior of a conventional handle or may comprise an integral part of a plastic handle.

20 Claims, 1 Drawing Sheet

52
54
50
14
12
10
16
20
34
34
18
3
3
20
36
36
10
12
14

16
30
28
26
18
22
32
24
20

44
5
5
40
42
44
40
42
44
46

TOOL AND TOOL HANDLE

This application is based on U.S. Provisional Patent Application Ser. No. 62/071,868 filed Oct. 6, 2014, priority of which is claimed and which is incorporated herein by reference.

This invention relates to hand held tools and more particularly to tool handles for hand held tools which have high gripping power.

BACKGROUND OF THE INVENTION

There are many industries and situations where hand held impact tools are swung with considerable force. One handed hammers, two handed sledge hammers and axes are common examples. In some situations, circumstances are such that the user cannot grip the tool handle securely. A common example is where the user's hands or the tool handle is wet. Oil, grease, drilling mud and other similar slick materials make it difficult to grasp a tool handle and swing the tool with the requisite force without losing grip of the handle. There are obvious safety concerns to the user, to bystanders and to nearby equipment.

There have been some attempts made in manufactured tool handles to make them rougher, as with grooves, ribs of hard or soft rubber and the like. There have been improvised attempts as with string, tape or the like wound around the handle.

Disclosures of interest are found in U.S. Pat. Nos. 3,585,101; 4,825,552; 5,097,566; 5,234,740; 6,372,323; 6,610,382; 7,309,519; 7,703,179 and 8,277,922 along with U.S. Printed Patent Application; 2012/0027990 and Japan Patent 2012158091.

SUMMARY OF THE INVENTION

A tool handle includes a series of outwardly extending pegs which are sufficiently far apart to allow the user's hand to abut the tool handle. The pegs are rigid, meaning they indent the skin of the user when the tool handle is forcibly grasped. In some embodiments, the pegs are long enough and spaced far enough apart to make it overly painful to grasp and forcibly swing the tool bare handed. In some embodiments the pegs are embedded in a molded handle or formed during molding of a handle. In other embodiments, the pegs are captivated against an exterior of the handle, as by the use of shrink wrap bands.

It is an object of this invention to provide an improved tool and tool handle.

Another object of this invention is to provide an improved tool handle for impact tools which provides high gripping power.

These and other objects and advantages of this invention will become more fully apparent as this description proceeds.

DETAILED DESCRIPTION OF THE INVENTION

Figures 1, 2, 3, 4, 5, 6:
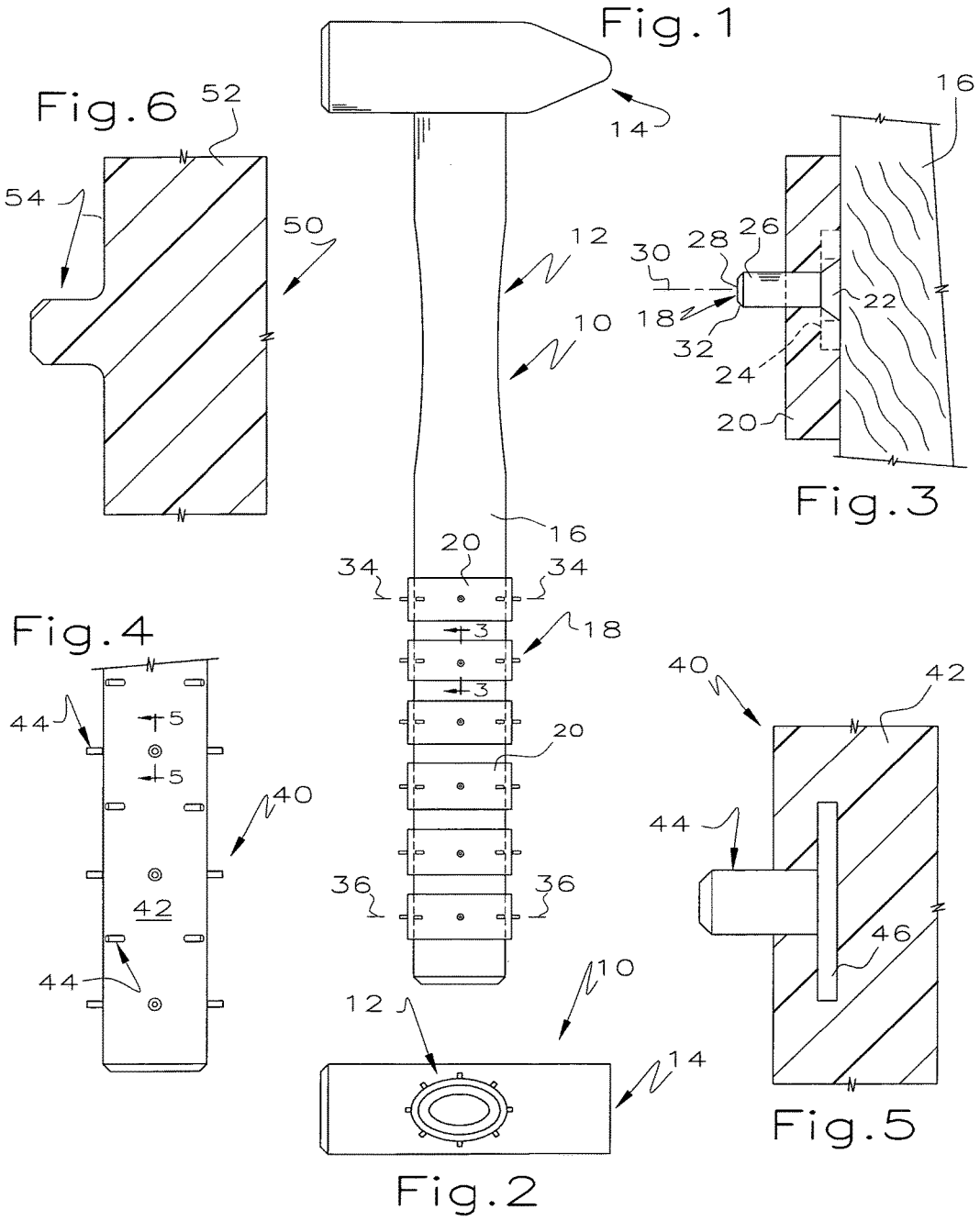
FIG. 1 is a side view of a hand held tool incorporating a handle of this invention.
FIG. 2 is an end view of the tool handle of FIG. 1.
FIG. 3 is a cross-sectional view of FIG. 1, taken substantially along line 3-3 thereof as viewed in the direction, indicated by the arrows.
FIG. 4 is a partial side view of another embodiment of a tool handle of this invention.
FIG. 5 is a cross-sectional view of FIG. 4, taken substantially along line 5-5 thereof as viewed in the direction indicated by the arrows.
FIG. 6 is a cross-sectional view, similar to FIG. 5, of another embodiment of a tool handle.

Referring to FIGS. 1-3, there is illustrated an impact tool 10 such as a one handed hammer having a handle 12 and an impact head 14. The impact tool 10 may be of any suitable type such as the hammer/chisel form shown, a sledge hammer, axe, maul or the like.

The handle 10 includes a conventional shaft 16 which is typically of wood but which may be of any suitable material, such as plastic, metal, fiberglass or the like. A series of rigid pegs 18 are captivated to the shaft 16 in any suitable manner, as by the use of sections of shrink wrap tubing 20. The pegs 18 include an enlarged head 22 which may be buttressed by a beveled or unbeveled washer 24 and a shaft 26 which protrudes through an opening in the tubing 20. The peg shaft 26 may terminate in a flat blunt end 28 perpendicular to an axis 30 of the shaft 26 and may preferably include a tapered, beveled or chamfered edge 32 to avoid a sharp edge on the end 28 of the peg 18.

The pegs 18 may extend outwardly from the handle 12 in a more-or-less radial fashion as shown in FIG. 2. The pegs 18 may be symmetrically placed about the handle 12 as in FIG. 2 where the pegs 18 are spaced 45° apart or may be more randomly positioned. Similarly, each group of pegs 18, i.e. those bound to the shaft 16 by a single length of tubing 20, may be identically positioned to the group above or below it or may be staggered in some fashion. The number of pegs 18 bound by each of the tubing sections 20 may vary considerably but there may be 4-20 pegs 18 bound by each of the tubing sections 20 and may preferably be 6-8 pegs 18 for each tubing section 20. There may be a series of tubing sections 20 or a single long length of tubing 20 in which the pegs 18 are held.

To apply the pegs 18 to the handle shaft 16, the washers 24 are installed on the pegs 18, the pegs 18 are passed through openings in the tubing 20 which are then slipped over the end of the handle shaft 16 to a desired location. A heat gun (not shown) such as a hair dryer is used to shrink the tubing 20 onto the shaft 16 and thereby captivate the pegs 18 to an exterior of the handle 12. Some shrink wrap material includes glue on the underside and some may not. In any event, glue may be added to the underside of the tubing 20 to promote adhesion to the handle 12.

The function of the pegs 18 is to increase the frictional forces between the user's hand and the handle 12. By making the pegs 18 small in area, spaced widely apart and relatively long, the forces in some embodiments are so great that a user cannot hold the hammer 10 bare handed and swing in a normal forceful manner because the pain is too great. This may sound disadvantageous but, in some industries like the upstream oil and gas industry, it is counter-intuitively desirable because workers are encouraged or required to wear gloves. By making the pegs 18 so the handle 12 is painful to grasp, one accomplishes two ends, i.e. create maximum frictional force between the user's hand and the handle 12 and encourage the worker to wear gloves.

In one sense, the measurement of pain is a subjective matter but, in another sense, is subject to objective consideration. As used herein, the pain being so great that the person cannot hold onto the handle and swing it forcibly means that at least ninety percent of a random selection of adult American males cannot drive a common six penny nail completely into the short side of a 2×4 commercial grade piece of lumber in thirty seconds while gripping the handle bare handed in the gripping area between the upper and lower peg boundaries.

To promote the frictional forces between the handle 12 and the user's hand, it is desirable to make the pegs 18 of small cross-sectional size, widely dispersed and sufficiently long. The cross-sectional area of each peg shaft 26, taken perpendicular to the axis 30 along a section of maximum diameter or value, is relatively small and may be in the range of 0.002-0.07 square inches each and may preferably be in the range of 0.008-0.02 square inches each. It may be preferred that each of the pegs 26 be identical for ease of manufacture but the pegs 18 may be of mixed cross-sectional size if desired.

The peg shaft 26 may be of complex shape but may preferably or conveniently be slightly tapered or cylindrical. The diameter of cylindrical peg shafts 26 may vary considerably but typically may be in the range of 0.05-0.3 inches and may preferably be in the range of 0.08-0.20 inches.

The cumulative cross-sectional area of the pegs 18 is very small compared to the surface area of either the shrink wrap tubing 20 or to the handle shaft 16. The more appropriate comparison in the embodiment of FIGS. 1-3 is to the diameter of the tubing sections 20 which abuts the user's hand or glove in use. The cumulative cross-sectional area of the pegs 18, from an upper peg boundary 34 to a lower peg boundary 36 which constitute the gripping area of the handle 16, may be in the range of about ½-8% of the area between the boundaries 34, 36. The cumulative cross-sectional area of the pegs 18, between the boundaries 28, 30, may preferably be in the range of 1-2.5%. The exact number of pegs in any particular embodiment depends, of course, on the cross-sectional area of each peg.

The pegs 18 do not have to be symmetrically or evenly dispersed on the handle shaft 16 as shown in the drawings but there is no adult male hand sized area on the handle shaft 16, i.e. a distance of 3" or greater along the axis of the shaft 16, between the boundaries 34, 36 that is free of pegs 18. In some embodiments, there may preferably be at least one peg 18 in any square having an area of two square inches between the boundaries 34, 36.

One factor determining the rigidity of the pegs 18 is the material from which they are made. The pegs 18 may be of any suitable metal, plastic or composite of considerable hardness. The pegs may be soft metals such as copper or aluminum having a 2.5 or greater hardness on the Mohs scale. Copper alloys, aluminum alloys, iron and iron alloys are, of course, considerably harder and may be used. Hard polymers such as polycarbonates, polypropylene, polyamides and similar plastics having a Shore Durometer in excess of 70 may also be used. Plastics presumptively have a disadvantage because, when broken, they produce sharp edges. Sharp edges in fact promote frictional forces between the user's glove and the handle 16 but they wear gloves at an inordinately high rate.

Another factor determining the rigidity of the pegs 18 is the length of the pegs 18 above the surface of the sections 20 relative to their diameter. When the pegs 18 are made of suitable metals or plastics and are no longer than 0.4" long, they remain rigid and are not flexible because of overly large aspect ratios.

The exposed length of the pegs 18 above the shrink wrap tubing sections 20 has another effect. If the pegs 18 are too short, they do not produce sufficient frictional forces. If the pegs 18 are too long, they become like spikes and are too sharp. The pegs 18 may be exposed above the shrink wrap section 20 in the range of 0.05-0.4" and may preferably extend in the range of 0.1-0.2" above the exterior of the shrink wrap tubing sections 20. Although the pegs 18 shown in FIGS. 1 and 2 are of the same length above the exterior of the tubing 20, they may be of random length and may extend at different lengths above the tubing 20.

Referring to FIGS. 4-5, there is illustrated another tool handle 40 which may be molded from a suitable polymer, fiberglass, composite material or the like. The handle 40 accordingly includes a shaft 42 in which are embedded a series of rigid pegs 44. The pegs 44 may include an enlarged lower end or flange 46 promoting retention of the peg 44. The size, spacing and distribution of the pegs 44 relative to the handle shaft 42 may be the same as the size, spacing and distribution of the pegs 18 relative to the shrink wrap sections 20.

Referring to FIG. 6, there is illustrated another molded tool handle 50 having a handle shaft 52 from which extend a series of rigid pegs 54 which are integral with the handle shaft 52 and are molded from the same material as the handle shaft 52 during manufacture. The size, spacing and distribution of the pegs 54 relative to the handle shaft 52 may be the same as the size, spacing and distribution of the pegs 18 relative to the shrink wrap sections 20.

The type of work gloves which may be used with the handle 16 of this invention may vary widely. Plastic dot gloves, leather, suede and more modern work gloves, such as those made by Wells Lamont of Niles, Ill. which is a division of The Marmon Group of Chicago, Ill. or Ringers Gloves of Houston, Tex. and similar gloves may be suitable for use to swing the hammer 10 without the least discomfort. The basic reason that one can grasp the handle 16 without discomfort is that work gloves spread the effect of the blunt peg ends 28 over a greater area of the user's hand.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A hand held tool having an impact head and a handle providing rigid pegs extending away from the handle in a gripping area, the pegs extending above an exterior of the handle a sufficient distance and being so widely spaced that at least ninety percent of a random selection of adult American males cannot drive a common six penny nail completely into the short side of a 2×4 commercial grade piece of lumber in thirty seconds handling the tool bare handed in the gripping area because the pain is so great.

2. The hand held tool of claim 1 wherein the tool is a hammer.

3. The hand held tool of claim 1 wherein the handle is made of a material selected from the group consisting essentially of polymers, fiberglass and composites and the pegs are embedded in the handle.

4. The hand held tool of claim 1 wherein the handle is made of a material selected from the group consisting essentially of polymers, fiberglass and composites, the pegs are integral with the handle and the pegs are of the same material as the handle.

5. The hand held tool of claim 1 further comprising bands of material captivating the pegs to an exterior of the handle.

6. The hand held tool of claim 5 wherein the bands of material comprise a shrink wrap polymer.

7. The tool handle of claim 1 wherein the pegs include a peg shaft having an end including a flat end section and a beveled edge between the flat end section and the peg shaft.

8. A tool handle for a hand held tool having a handle shaft, the handle shaft including a series of outwardly projecting rigid pegs located between upper and lower peg boundaries on the handle shaft, the cumulative cross-sectional surface area of the pegs being in the range of ½-8% of the area of the handle shaft between the upper and lower peg boundaries, the pegs being of a material having a Mohs hardness in excess of 2.5.

9. The tool handle of claim 8 wherein the handle shaft is made of a material selected from the group consisting essentially of polymers, fiberglass and composites and the pegs are embedded in the handle shaft.

10. The tool handle of claim 8 wherein the handle is made of a material selected from the group consisting essentially of polymers, fiberglass and composites, the pegs are integral with the handle and the pegs are of the same material as the handle.

11. The tool handle of claim 8 further comprising bands of material captivating the pegs to an exterior of the handle shaft.

12. The tool handle of claim 11 wherein the bands of material comprise a shrink wrap polymer.

13. The tool handle of claim 8 wherein the cumulative cross-sectional area of the pegs is 1-2.5% of the area between the upper and lower peg boundaries.

14. The tool handle of claim 13 wherein there are no pegs outside the upper and lower peg boundaries.

15. The tool handle of claim 8 wherein each peg has a maximum cross-sectional area in the range of 0.002-0.07 square inches.

16. The tool handle of claim 15 wherein each peg has a cross-sectional area in the range of 0.008-0.02 square inches.

17. The tool handle of claim 8 wherein each peg extends above an exterior of the handle for a distance in the range of 0.05-0.4".

18. The tool handle of claim 17 wherein each peg extends above an exterior of the handle for a distance in the range of 0.1-0.2".

19. The tool handle of claim 8 wherein the pegs are from a group consisting essentially of a metal having a Mohs hardness in excess of 2.5 and a polymer having a Shore Durometer hardness in excess of 70.

20. A handle for a hand held tool comprising a handle shaft, a series of outwardly projecting rigid pegs located between first and second locations on the handle shaft, the cumulative surface area of the pegs being in the range of ½-8% of the area of the handle between the first and second locations, the pegs being of a material selected from the group consisting essentially of metal having a Mohs hardness in excess of 2.5 and a polymer having a Shore Durometer hardness in excess of 70, each peg having a maximum cross-sectional area in the range of 0.002-0.07 square inches, each peg extending above an exterior of the handle for a distance in the range of 0.05-0.4".

* * * * *